United States Patent [19]

Britton

[11] 4,179,641

[45] Dec. 18, 1979

[54] CIRCUITS FOR OPERATING DISCHARGE LAMPS

[75] Inventor: John Britton, West Kingsdown, England

[73] Assignee: The General Electric Company Limited, London, England

[21] Appl. No.: 876,229

[22] Filed: Feb. 9, 1978

[30] Foreign Application Priority Data

Feb. 9, 1977 [GB] United Kingdom ..... 5312/77

[51] Int. Cl.[2] ..... H05B 41/16

[52] U.S. Cl. ..... 315/289; 315/106; 315/290; 315/DIG. 7

[58] Field of Search ..... 315/101, 105, 106, 244, 315/246, 289, DIG. 5, DIG. 7, DIG. 2, 290

[56] References Cited

U.S. PATENT DOCUMENTS

| | | | |
|---|---|---|---|
| 3,978,369 | 8/1976 | Imaizumi et al. | 315/99 |
| 4,015,167 | 3/1977 | Samuels | 315/105 X |

FOREIGN PATENT DOCUMENTS 1289118 9/1972 United Kingdom .

OTHER PUBLICATIONS

Moerkens, *An Electronic Starter for Long Fluorescent Lamps*, Philips Technical Review, vol. 31, No. 2, 1970, pp. 54–58.

*Primary Examiner*—Eugene R. LaRoche
*Attorney, Agent, or Firm*—Kirschstein, Kirschstein, Ottinger & Cobrin

[57] ABSTRACT

An electrical circuit for operating an electrical discharge lamp has a pair of terminals for connection to a supply of voltage of substantially sinusoidal waveform, a second pair of terminals for connection with a discharge lamp, a ballast impedance connected between one of the first pair of terminals and one of the second pair of terminals, a starting device for aiding initiation of discharge in the lamp and means for disabling the starting device when a discharge has been initiated in the lamp. The means for disabling the starting device operates in response to a change in the voltage waveform across the second pair of terminals from substantially sinusoidal to substantially square.

3 Claims, 5 Drawing Figures

CIRCUITS FOR OPERATING DISCHARGE LAMPS

This invention relates to electrical circuits for operating electrical discharge lamps.

The invention relates particularly to such circuits of the kind comprising a pair of terminals for connection to a supply of voltage of substantially sinusoidal waveform; a second pair of terminals for connection with a discharge lamp; a ballast impedance connected between one of the first pair of terminals and one of the second pair of terminals; a starting device for aiding initiation of a discharge in the lamp; and means for disabling the starting device when a discharge has been initiated in the lamp. Such a circuit will be referred to hereinafter as a circuit of the kind specified.

In known circuits of the kind specified the disabling means typically comprises means for detecting changes in the amplitude of the voltage across the second pair of terminals or means for detecting changes in the phase difference between the voltage across the second pair of terminals and the voltage across the first pair of terminals or a combination of both such means. The magnitude of such changes, however, is dependent on the voltage across the first pair of terminals and so fluctuates with fluctuations in this voltage and depends upon the characteristics of the particular discharge lamp which the circuit is operating, resulting in problems of compatibility between circuits of the kind specified and different discharge lamps. It is an object of the present invention to provide a circuit of the kind specified in which this problem is alleviated.

According to the present invention there is provided an electrical circuit for operating an electrical discharge lamp comprising: a pair of terminals for connection to a supply of voltage of substantially sinusoidal waveform; a second pair of terminals for connection with a discharge lamp; a ballast impedance connected between one of the first pair of terminals and one of the second pair of terminals; a starting device for aiding initiation of discharge in the lamp; and means for disabling the starting device when a discharge has been initiated in the lamp, wherein the means for disabling the starting device operates in response to a change in the voltage waveform across the second pair of terminals from substantially sinusoidal to substantially square.

Preferably the means for disabling the starting device is arranged to process the waveform across the second pair of terminals to produce a signal having a first value when the lamp is unlit and a second value when the lamp is lit, and the starting device is arranged to be enabled in response to the signal having the first value and to be disabled in response to the signal having the second value.

In one particular circuit in accordance with the invention the means for disabling the starting device comprises: means for differentiating the voltage across the second pair of terminals; means for rectifying the output of the differentiating means; means for amplifying and limiting the output of the rectifying means; and means for smoothing the output of the amplifying and limiting means.

There will now be described by way of example one circuit according to the invention with reference to the accompanying drawings, in which.

Figure 1:
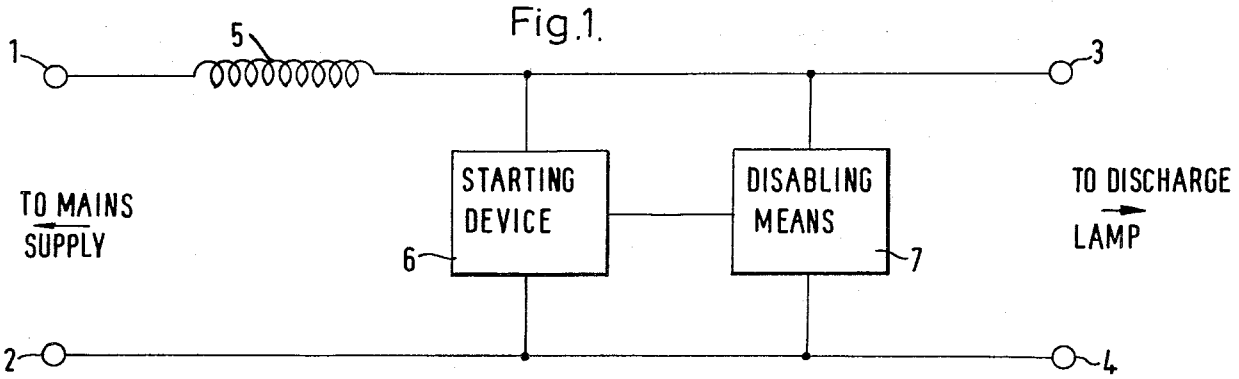
FIG. 1 shows a block schematic diagram of the circuit.

With reference to FIG. 1, the circuit comprises a pair of terminals 1, 2 for connection to a mains supply (not shown) of sinusoidal voltage and a pair of terminals 3, 4 for connection to a discharge lamp (also not shown). A direct connection is provided between terminals 2 and 4 and terminals 1 and 3 are connected through a ballast inductance 5. A starter device 6 is connected between the terminals 3 and 4. Means 7 for disabling the starter device 6 are also connected between the terminals 3 and 4 and to the starter device 6.

The circuit operates in the following manner. With the terminals 1, 2 connected to the mains and the terminals 3, 4 connected to a discharge lamp, the starter device 6 becomes conductive for a short period in each half cycle during which period a current builds up through the inductance 5 and the starter device 6. When the starter device 6 changes from being conductive to being non-conductive, a large voltage pulse is produced between the terminals 3 and 4 by virtue of the presence of inductance 5. The starter device 6 produces a further voltage pulse between the terminals 3 and 4 in each half cycle until one of the pulses initiates discharge in the discharge lamp to which the terminals 3, 4 are connected, thereby lighting the lamp. After the lamp is lit the pulses are no longer required and so the starter device 6 is then disabled by the disabling means 7 and thereafter remains non-conductive.

In accordance with the invention, the disabling means 7 detects when the voltage waveform across the terminals 3 and 4 changes from substantially sinusoidal, as occurs before the discharge lamp is lit, to substantially square, as occurs after the discharge lamp to which the terminals 3, 4 are connected is lit. Upon detection the disabling means 7 disables the starter device 6.

Figure 2:
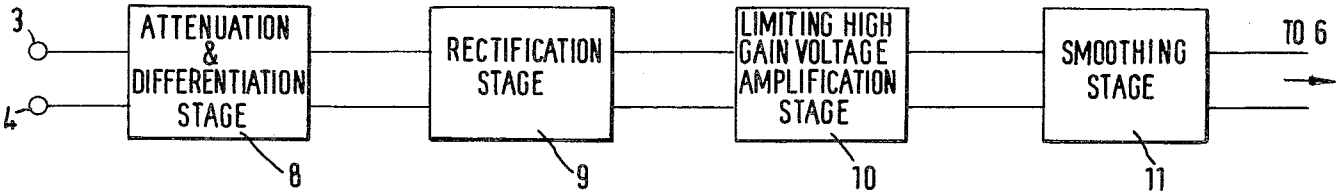
FIG. 2 shows, also in block schematic form, a more detailed diagram of a disabling means suitable for use in the circuit of FIG. 1.

The disabling means 7 detects the change in the voltage waveform across the terminals 3 and 4 by processing the waveform as follows. The waveform is processed by four stages, as shown in FIG. 2. The function of each of the stages may be appreciated from the waveforms appearing at various points in FIG. 2, as shown in their two states corresponding to the lit and unlit states of the discharge lamp to which the terminals 3, 4 are connected, in FIG. 3. The voltage waveform across the terminals 3, 4 (FIG. 3(*a*)) is first attenuated and differentiated by an attenuation and differentiation stage 8 to produce the waveform shown in FIG. 3(*b*). This waveform is then rectified by a rectification stage 9 to produce the waveform shown in FIG. 3(*c*). This waveform is then shaped by a limiting high gain voltage amplification stage 10 to produce the waveform shown in FIG. 3(*d*). This waveform is then smoothed by a smoothing stage 11 to produce the waveform shown in FIG. 3(*e*).

Figure 3:
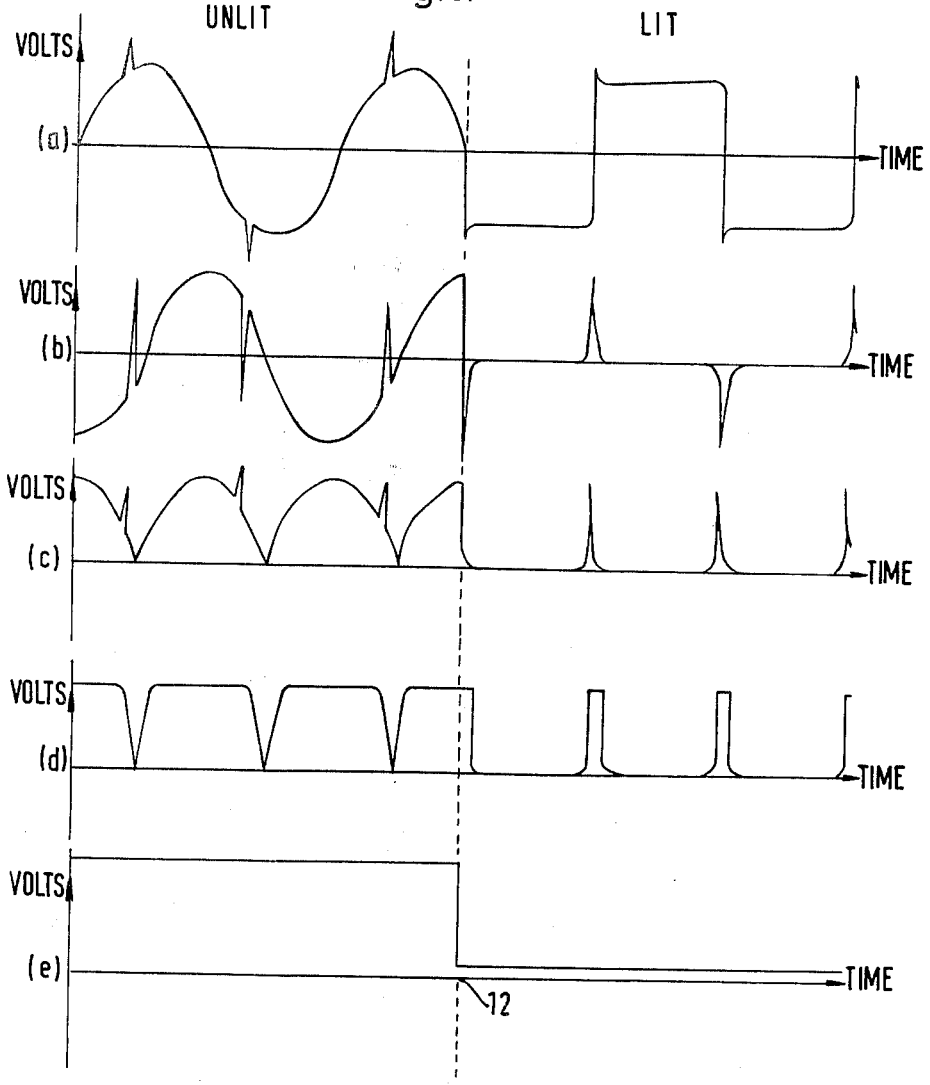
FIG. 3 shows the voltage waveforms at various points in the part of the circuit of FIG. 2.

The voltage whose waveform is shown in FIG. 3(*e*) has a steady, relatively high value when the lamp is unlit and changes rapidly when the lamp lights at the point 12 in FIG. 3(*e*) to a steady relatively low value. This change is used to disable the starter device 6.

Figure 4:
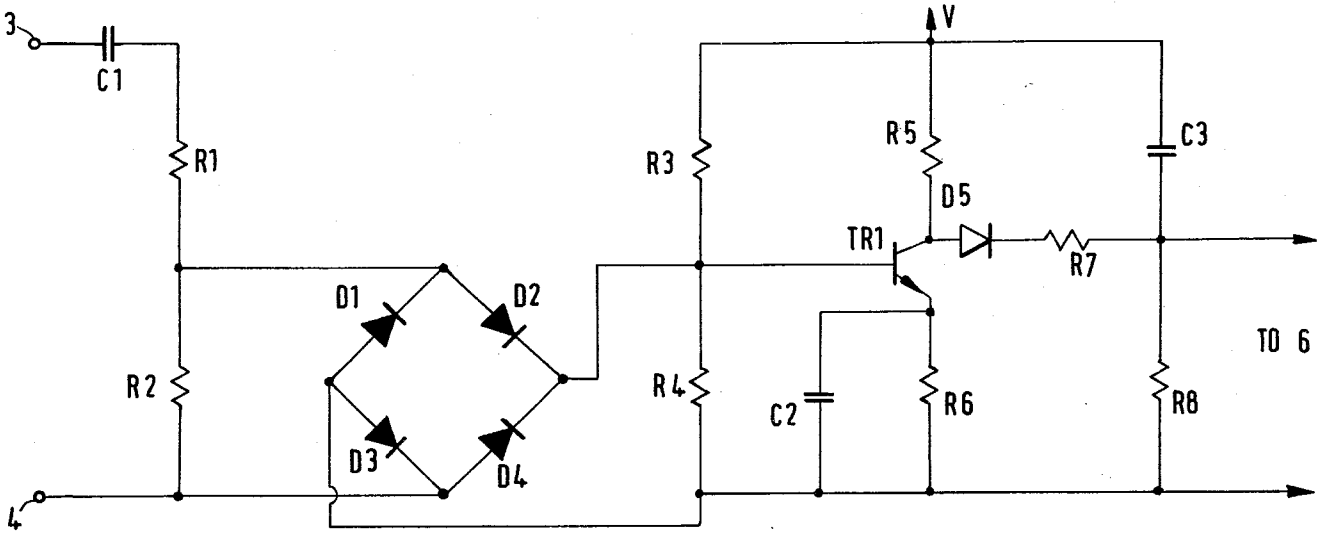
FIG. 4 is a circuit diagram of a practical embodiment of the disabling means shown in FIG. 2.

Referring now to FIG. 4, in one particular practical embodiment of the circuit of FIG. 2 the voltage appearing across the terminals 3, 4 of the circuit of FIG. 1 is differentiated by a CR circuit C1, R1, R2, which with a 50 Hz supply suitably has a time constant of about 1 millisecond. The differentiated signal is attenuated to a suitable level by the potential divider R1, R2. Thus the components C1, R1 and R2 correspond to the attenuation and differentiation stage 8 of FIG. 2.

The attenuated and differentiated signal is then rectified by a full-wave rectification diode bridge network comprising diodes D1 to D4. Thus the diode bridge network D1–D4 corresponds to the rectification stage 9 of FIG. 2.

The rectified signal is then amplified and limited by a transistor TR1, energised by a d.c. voltage V derived from the a.c. supply. The transistor is normally biased off by a base biasing network comprising R3 and R4. Also associated with the transistor are a standare d.c. feedback resistor R6, a.c. bypass capacitor C2 and a collector load resistor R5, the gain of transistor TR1 being chosen so that the output from the collector is squared. Thus the transistor network TR1, R3–R6 and C2 correspond to the limiting high gain voltage amplification stage 10 of FIG. 2.

The squared output is fed through a diode D5 which acts as a diode pump into a capacitor C3 through resistor R7. With a 50 Hz supply the time constant of the series resistance capacitance arrangement is arranged to be of the order of 1 ms so as to produce across resistor 8 a high smooth constant output voltage when the lamp is unlit and a low smooth constant output voltage when the lamp is lit. Thus components D5, C3, R7 and R8 correspond to the smoothing stage of FIG. 2.

Figure 5:
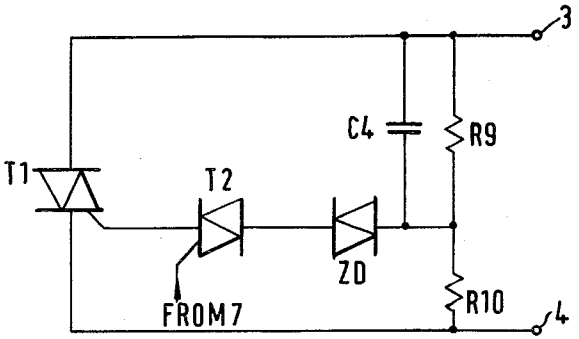
FIG. 5 is a circuit diagram of a starter device suitable for use in the circuit of FIG. 1.

Referring to FIG. 5, a starter device suitable for use with the circuit of FIG. 4 includes a triac T1 connected between the terminals 3, 4 to which the lamp is connected. The trigger electrode of the triac T1 is connected via a second triac T2 and a diac ZD to the junction between a pair of resistors R9 and R10 connected in series between the terminals 3 and 4, the resistor R9 being shunted by a shaping capacitor C4. The trigger electrode of the triac T2 is controlled by the voltage across resistor R8 of FIG. 4. When the lamp is unlit and the voltage across resistor R8 is high the triac T2 is conductive, allowing the breakdown of diac ZD to fire the tric T1 periodically and produce large voltage pulses across the lamp. When the lamp is unlit and the voltage across resistor R8 is low the triac T2 is non-conductive, so preventing triac T1 from firing and stopping the starting pulses.

It will be appreciated that many alternative forms of starting device and disabling means to those shown in FIGS. 4 and 5 may be used in a circuit according to the invention.

I claim:

1. An electrical circuit for operating an electrical discharge lamp, the circuit comprising:
   - a pair of terminals for connection to a supply of voltage of substantially sinusoidal waveform;
   - a second pair of terminals for connection with a discharge lamp;
   - a ballast impedance connected between one of the first pair of terminals and one of the second pair of terminals;
   - a starting device for aiding initiation of discharge in the lamp; and
   - means for disabling the starting device when a discharge has been initiated in the lamp,
   - wherein the means for disabling the starting device is arranged to detect a change in the voltage waveform across the second pair of terminals from substantially sinusoidal to substantially square.

2. An electrical circuit according to claim 1 wherein the means for disabling the starting device is arranged to process the waveform across the second pair of terminals to produce a signal having a first value when the lamp is unlit and a second value when the lamp is lit, and the starting device is arranged to be enabled in response to the signal having the first value and to be disabled in response to the signal having the second value.

3. An electrical circuit according to claim 2 wherein the the means for disabling the starting device comprises:
   - means for differentiating the voltage across the second pair of terminals;
   - means for rectifying the output of the differentiating means;
   - means for amplifying and limiting the output of the rectifying means; and
   - means for smoothing the output of the amplifying and limiting means.

* * * * *